United States Patent [19]

Walker

[11] 4,378,639

[45] Apr. 5, 1983

[54] METHOD AND APPARATUS FOR UNIFORMLY DRYING A CONTINUOUS WEB OF CELLULOSIC FIBERS

[75] Inventor: Peter J. Walker, Pointe Claire, Canada

[73] Assignee: Midland-Ross Corporation, Cleveland, Ohio

[21] Appl. No.: 274,608

[22] Filed: Jun. 17, 1981

Related U.S. Application Data

[63] Continuation of Ser. No. 971,854, Dec. 21, 1978, abandoned.

[51] Int. Cl.[3] ..... F26B 3/24; F26B 13/08

[52] U.S. Cl. ..... 34/12; 34/23; 34/41; 34/54; 34/111; 34/116; 68/5 D; 68/205 R; 8/158; 162/207; 162/DIG. 6; 162/DIG. 11; 134/15; 134/122 R; 134/148

[58] Field of Search ..... 34/23, 33, 41, 43, 50, 34/111, 113, 114, 116, 119, 54; 68/5 D, 5 E, 205 R; 8/158; 162/207, 290, 252, DIG. 6, DIG. 10, DIG. 11; 134/15, 105, 122 R, 148

[56] References Cited

U.S. PATENT DOCUMENTS

| | | | |
|---|---|---|---|
| 2,337,163 | 12/1943 | Milne | 34/116 |
| 2,951,007 | 8/1960 | Lippke | 162/198 |
| 3,089,252 | 5/1963 | Daane et al. | 34/34 |
| 3,510,374 | 5/1970 | Walker | 162/DIG. 6 |
| 3,687,802 | 8/1972 | Rummel et al. | 162/DIG. 6 |
| 3,859,163 | 1/1975 | Haythornthwaite | 162/199 |

*Primary Examiner*—Larry I. Schwartz
*Attorney, Agent, or Firm*—Harlan E. Hummer

[57] ABSTRACT

A method and apparatus used in the uniform drying of a continuous web, such as a sheet of paper or paperboard. A newly formed web of paper of wet cellulosic fibers and the necessary additives is initially directed through a press section where excessive water is squeezed from the web to reduce its moisture content to about 50–80 percent, by weight, for subsequent passage through a dryer section wherein the moisture content is further reduced to anywhere between 3 and 15 percent, depending on the quality of the paper being processed. The moisture content profile of the nearly dry web of paper is constantly monitored adjacent the discharge end of the dryer section for dry streaks which occasionally occur in the web. Moisture is added accordingly to the web when the web is relatively wet and has a moisture content of at least 25 percent to eliminate further dry streaks and provides a paper product which has a uniform moisture content.

13 Claims, 2 Drawing Figures

METHOD AND APPARATUS FOR UNIFORMLY DRYING A CONTINUOUS WEB OF CELLULOSIC FIBERS

This is a continuation of application Ser. No. 971,854, filed Dec. 21, 1978 now abandoned.

BACKGROUND OF THE INVENTION

The invention is useful in the production of continuous webs of wet fibrous materials, especially webs of cellulosic fibers used in the production of paper products, such as paper and paperboard. The drying of such webs is extremely important in the production of quality papers which should have as uniform moisture content as possible.

U.S. Pat. No. 3,864,842 relates to a multicylinder dryer section of a paper machine, and discloses numerous defects which can occur as a result of the non-uniform drying of a web of paper. This patent is typical of the many patents which are directed to the profiling of heat transversely of a traveling web by means of differently heated cylinders or streams of air to more uniformly dry the web and eliminate wet or dry streaks in the web, i.e. streaks which extend in the machine direction or longitudinally of the web and wherein the moisture content is appreciably different from portions of the web adjacent the streaks.

U.S. Pat. No. 3,948,721 relates the problems of dry streaking in greater detail, and describes how atomized sprays of water are utilized at the discharge end of the dryer section to wet dry streaks which appear in the web, so that the final product will have a more uniform moisture content. It was found that this particular solution to the problem occasionally produced other undesirable side effects in the wetted areas of the paper; namely, unsightly water marks, wrinkles, and blackening of the paper during the calendering operation. The invention is directed to an improved method of adding water to the web to eliminate streaks in the web without experiencing any of the aforementioned side effects.

The term "dry end", as used herein and in the claims, means a point along the pathway or line which the web travels during processing, where the moisture content of the web is 20 percent or less, by weight, whereas the term "wet end" means a point along the processing pathway or line where the moisture content of the web is at least 25 percent.

Briefly stated, the invention is in a method and apparatus used in the production of a continuous web composed of fibrous material, such as wood pulp used in the formation of a sheet of paper or paperboard. The method comprises the formation of wet fibrous material into a continuous web having a high moisture content which is reduced to about 50–70 percent, by weight, by passing the web through a press section, after which the web is guided through a dryer section, wherein the web is heated to reduce the moisture content even further to a desired level, e.g. below 10 percent, as it moves longitudinally along a pathway or processing line through the dryer section. The web is constantly monitored at the dry end of the processing line for dry streaks. In response to the sensing of a dry streak, a water spray that is upstream in the wet end of the processing line and longitudinally aligned with the dry streak sensed, is operated to accordingly wet the adjacent correlated area of the web to eliminate further dry streaks downstream in the dry end and consequently produce a web having a more nearly uniform moisture content.

An apparatus, designed to carry out the aforementioned process, comprises, for example, a series of heated cylinders which define the processing line, and associated felts for pressing the web against the heated cylinders. A sensor is located at the dry end of the processing line, usually adjacent the discharge end of the dryer section, whereas the sprays, responsive to the sensor, are positioned in the wet end of the processing line usually adjacent the charging end of the dryer section. The sprays are positioned to spray water directly against areas of the web correlated to the dry streaks requiring additional moisture, or against sections of a dryer felt which, in turn, contacts the correlated area of the web requiring wetting.

Another aspect of the invention is the provision of monitors in the dry end of the processing line to sense both dry and wet streaks. Similar correlated sprays and steam nozzles are located in the press section, just prior to the last press, to spray water or steam against appropriate sections of a felt that contact correlated areas of the web needing wetting or drying, prior to passage of the web through the last press of the press section. Water from the sprays cool the felt which, in turn, raises the viscosity of the water in the web which the felt contacts to subsequently reduce the amount of water removal in the press section, whereas steam from the nozzles has just the opposite effect, i.e. the steam heats the felt which lowers the viscosity of the water in the web which the felt contacts to improve the removal of water from the web in the press section. Thus, both the wetness and dryness of the web can be alternately controlled by the application of water and steam in the wet end of the processing line.

DESCRIPTION OF THE DRAWING

The following description of the invention will be better understood by having reference to the annexed drawing wherein.

ENVIRONMENT OF THE INVENTION

Figure 1:
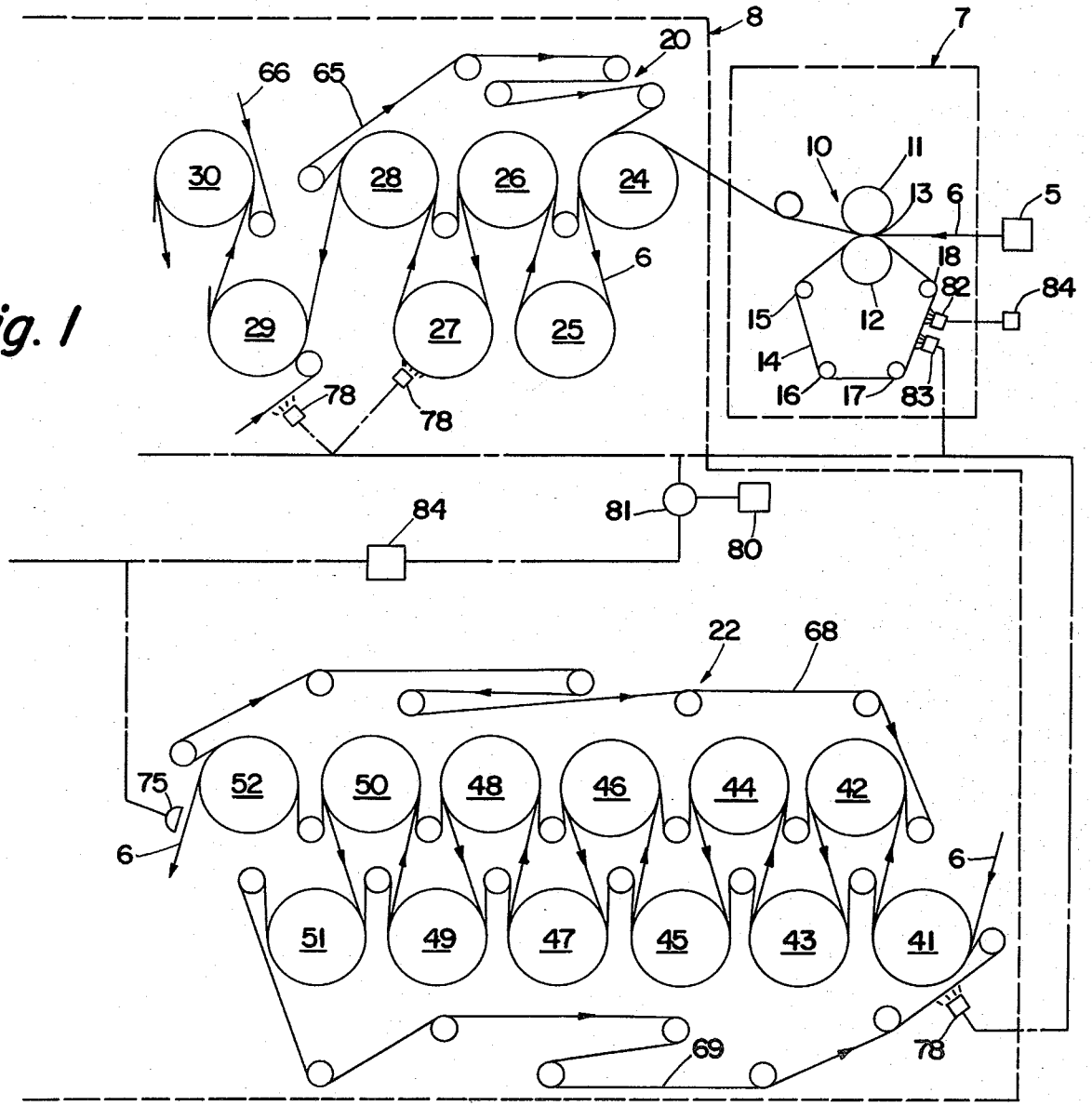
FIG. 1 is a schematic of a machine used in the production of paper, including the last press of a press section and a dryer section.

With reference to FIG. 1, there is shown a conventional Fourdrinier, or other suitable papermaking machine 5, wherein fibrous material, such as wood pulp, is formed into a continuous sheet or web 6 of paper. The web 6 is successively guided through a press section 7 where excessive water is squeezed from the web to reduce the moisture content of the web 6 from, for example, 80%–85% to 50%–70%, and a dryer section 8 where the moisture content of the web 6 is further reduced to 12%–15% or less, depending on the grade of paper being processed.

The press section 7 is comprised of a number of similar presses, e.g. press 10 which, in this instance, is the third and final press. The third press 10 comprises a pair of opposing cylinders 11,12 which form a nip 13 through which the web 6 travels for squeezing with a conventional press felt 14 that simultaneously passes through the nip 13 and around and between the vertically lowermost cylinder 12 and a plurality of staggered guide rollers 15–18 which take up the slack in the continuous felt 14.

The web 6, upon leaving the press section 7, travels successively through the dryer section 8 which, in this instance, is a multicylinder dryer that consists of four individual drying sections 20–23 which are spaced along a pathway formed by a first series of staggered cylinders 24–28 in the first drying section 20, a second series of staggered cylinders 29–40 in the second drying section 21, a third series of staggered cylinders 41–52 in the third drying section 22, and a fourth series of staggered cylinders 53–64 in the fourth and final drying section 23. The cylinders 24–64 are heated with steam to correspondingly heat the web 6 and reduce the moisture content thereof to the desired level as the web 6 exits the final drying section 23. A number of continuous dryer felts 65–71 are passed around and between the cylinders 24–64 and a series of strategically located guide rollers to press the web 6 against the heated cylinders 24–64 of the dryer section 8, so that there is a maximum transfer of heat to the web 6. The web 6 travels from the dryer section 8 through a calender stack 72 onto a windup assembly 73. The following invention is also applicable to a dryer section which employs hot air nozzles for heating the traveling web 6.

THE INVENTION

Any suitable device 75, for sensing and measuring the moisture content of a web, is positioned at the dry end 76 of the processing line or pathway to monitor the moisture content of the traveling web 6 and sense the web 6 for dry streaks. The sensing device 75, in this instance, is located adjacent the web 6 as it exits the final drying section 23, where the moisture content of the web 6 may be 5%–7% for fine quality papers, or 10%–12% or higher for other grades of paper. The sensing device 75 may be alternately positioned adjacent the web 6 as it exits the third drying section 22. A good workable sensing device 75 is one manufactured by the Measurex Corporation, or the Industrial Nucleonics Corporation and comprises a cross machine profiling a sensor which moves laterally across the web 6 while checking the moisture content of adjacent portions of the web 6. The sensing device 75 records where the moisture content of the web 6 is appreciably lower than the desired moisture content of the remaining portions of the web 6, relative to its position transversely of the web 6.

As previously indicated, a spraying device 77 has been used to spray finely atomized water against appropriate areas of a sheet of paper at the dry end of the line as a means of eliminating dry streaks in the paper. The spraying device 77 has been tried, without complete success, in a number of alternate positions adjacent the web 6 as it enters and exits the final drying section 23 (note alternate location of sprays 77 in FIG. 1). It has been discovered to be far more desirable and advantageous to apply moisture to the web 6 when it is wet, not dry, i.e. when the moisture content of the web 6 is at least 25% and preferably greater than 35% in the range of from 45%–65%, and, in some cases, when the web 6 is extremely wet, prior to passage through the last press 10 of the press section 7. Moisture added to a wet web is readily distributed by capillary action to all parts or interstices of the web during the course of the drying process, contrary to the resistance to distribution which moisture encounters when applied to the hard, dry surface of a dry web wherein the moisture content is less than 20%.

Figures 1, 2:
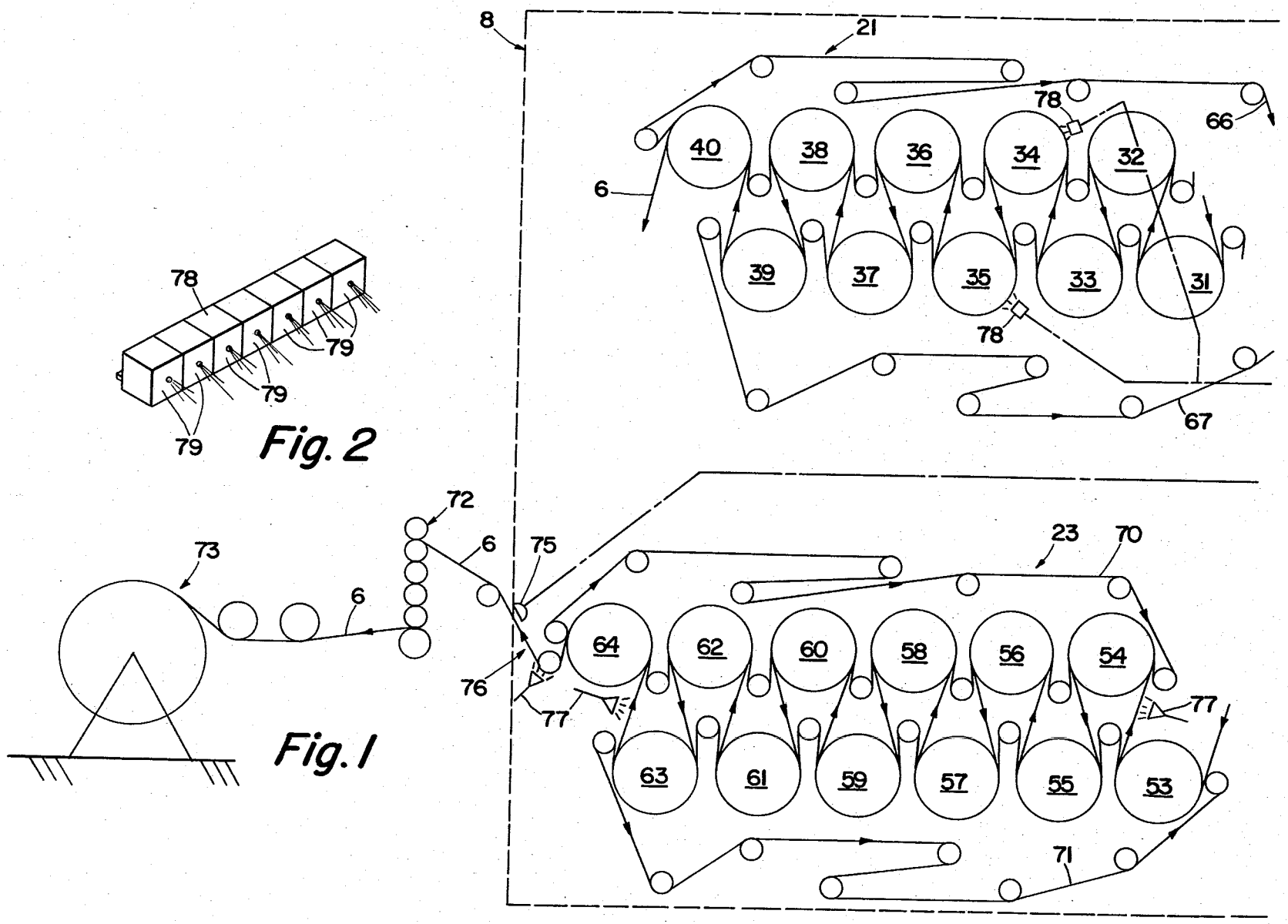
FIG. 2 is a perspective of a plurality of individual sprays which are disposed transversely across the traveling web to selectively add moisture to the web where needed.

Accordingly, a spraying device 78 (FIG. 2), responsive to the sensing device 75, is positioned in the wet end of the processing line to wet areas of the web 6 which are correlated to the dry streaks sensed by the sensing device 75, i.e. areas of the web 6 which are in the wet end of the line upstream from, and longitudinally aligned with, a dry streak sensed in the dry end of the line. The spraying device 78 is comprised of a number of individual sprays 79 which are spaced transversely across the web 6 and which are correlated and responsive to the sensing device 75 as it traverses the web 6.

The spraying device 78, as best seen in FIG. 1, can be located in a number of positions. For example, the spraying device 78 is best located for spraying water directly against the web 6 as it travels around the next to last cylinder 27 in the first drying section 20. Alternately, the spraying device 78 can be positioned for indirectly wetting the web 6 by spraying water against the dryer felts 66 or 67 adjacent the cylinders 34,29 or 35 in the second drying section 21, or by spraying water against the dryer felt 69 adjacent the first-to-encounter cylinder 41 in the third drying section 22.

In operation, the sensing device 75 constantly monitors the moisture content of the traveling web 6 at the dry end 76 of the line. Upon sensing a dry streak, the sensing device 75, triggers, for example, a correlated visible or audible signal which locates the dry streak transversely of the web 6. The correlated individual spray 79 of the spraying device 78, located in any of the aforementioned locations, is manually actuated by an operator to correspondingly wet the area of the web 6 longitudinally upstream from the sensed dry streak to eliminate any further dry streaks in that particular area of the web 6. Water is pumped through the individual sprays 79 from a source of supply 80 by any suitable pumping mechanism 81. The disparity between monitoring the web 6 for dry streaks at the dry end of the line and applying the necessary moisture at the wet end of the line is inconsequential because of the high speeds of from 1200 to 3000 feet per minute (fpm) at which the web 6 travels along the processing line or pathway.

The web 6 can also be continuously monitored for abnormal wet streaks as well as for dry streaks and corresponding mechanisms actuated to, accordingly, decrease or increase the moisture content of the web 6 in a specific area to eliminate any such streaks. For example, wet and dry streaks can be regulated by the operation of a steam nozzle 82 or similar water spraying device 83 to influence the viscosity or amount of water in the felt 14 adjacent the last press 10 of the press section 7. The steam is received from any suitable source 84.

Instead of manually operating the individual sprays 79 of the spraying device 78 or the steam nozzle 82 in response to the sensing of a dry or wet streak, the sensing device 75 can be adapted to send an appropriately translated signal to a computer 84 which, in turn, is programed to automatically control operation of the correct spray 79, or 83, or steam nozzle 82 to properly wet or dry the web 6 to eliminate excessively dry or wet streaks occurring in the web 6 at the dry end of the line.

Thus, there has been described a simple method and apparatus for controlling the uniformity of the moisture content of a paper product by appropriately wetting or, if need be, drying the necessary area of the product in the wet end of the line to eliminate a correlated dry or wet streak occurring and sensed in the dry end of the line. The problems of water marks, wrinkling, and blackening of the paper occasioned with prior art devices is eliminated to produce a sheet of paper having a more nearly uniform moisture content.

What is claimed is:

1. A method of uniformly drying a continuous web of wet fibrous material as the web travels along a processing line, comprising:

(a) constantly monitoring the moisture content of the web to sense dry streaks therein below a certain desired moisture content, when the web is in a dry end of the line where the moisture content of the web is less than 20%, by weight, and (b) adding moisture to the web in areas thereof which are spaced substantially upstream from the dry end and longitudinally aligned with any dry streaks sensed in the dry end of the line, the moisture being added in accordance with the moisture content of any such dry streaks, when the web is in a wet end of the line where the moisture content of the web is greater than 25%, and at least 50% greater than the moisture content thereof where monitored at the dry end of the line, and where the web moisture content is not less than 35% of its moisture content before drying is begun, the differential in moisture content between the area of moisture monitoring and the areas of moisture addition being at least 10%.

2. The method of claim 1, wherein moisture is added when the web has a moisture content of at least 35%.

3. The method of claim 2, wherein moisture is added when the web has a moisture content in the range of from 45% to 65%.

4. The method of claim 1, wherein moisture is added via a dryer felt which contacts the web.

5. The method of claim 1, wherein the moisture content of the web is regulated via a dryer felt which is alternately wetted and cooled by water and heated by steam and which contacts the web, prior to squeezing of the web in the last-to-encounter press of a press section.

6. The method of claim 1, wherein the web is transversely monitored for dry streaks at a point along the pathway where the web has a moisture content less than 10%.

7. The method of claim 1, wherein an area of the web is wetted via a dryer felt which is wetted accordingly and contacts the correlated area of the web.

8. An apparatus used in the production of a continuous web of cellulosic fibers such as a sheet of paper or paperboard, comprising:

(a) means for forming wet cellulosic fibers into a continuous web;

(b) a press section for squeezing excess liquid from the web as it travels along a pathway;

(c) a dryer section through which the web travels along the pathway subsequent to passage through the press section, the dryer section including means for heating the web to reduce the moisture content thereof to a desired level where the moisture content is less than 10% to 15%;

(d) means for monitoring the web to sense dry streaks at a point along the pathway where the web has a moisture content less than 20%, a dry streak having a moisture content below a desired level whereat the web is monitored; and (e) means for adding moisture to the web at an area spaced substantially upstream from the dry end, and longitudinally aligned with a sensed dry streak at a point along the pathway where the web has a moisture content greater than 25% and at least 50% greater than the moisture content thereof where monitored at the dry end of the line, and where the web moisture content is not less than 35% of its moisture content before drying is begun, the difference in moisture content between the area of moisture monitoring and the areas of moisture addition being at least 10%.

9. The apparatus of claim 8, wherein the moisture monitoring means are located at a point along the pathway where the moisture content of the web is less than 10%, and the moisture adding means are located at a point along the pathway where the moisture content of the web is greater than 35%.

10. The apparatus of claim 9, wherein the web heating means includes a number of cylinders staggered above and below a horizontal plane, and means for heating the cylinders.

11. The apparatus of claim 10, wherein the means for adding moisture to the web includes means for spraying liquid against a section of dryer felt which contacts and presses the web against a heated cylinder, a correlated area of web which is longitudinally upstream from a sensed dry streak.

12. The apparatus of claim 11, wherein the means for adding moisture to the web includes means for spraying liquid against a section of dryer felt which contacts the web prior to contact of the web with the press.

13. The apparatus of claim 12, which includes:

(f) means for monitoring the web to sense wet streaks having a moisture content above a desired level and at a point along the pathway where the moisture content of the web is less than 10% to 15%; and (g) means for directing steam against select sections of the dryer felt which contacts the web, prior to contact of the web with the press.

* * * * *